United States Patent [19]

de Lackner

[11] Patent Number: 4,989,795

[45] Date of Patent: Feb. 5, 1991

[54] ROLLER MILL JOURNAL LABYRINTH LUBRICATION SYSTEM

[75] Inventor: Donald P. de Lackner, 19931 Yucca Loma Rd., Apple Valley, Calif. 92308

[73] Assignee: Thomas A. de Lackner, Palo Alto, Calif.

[21] Appl. No.: 439,866

[22] Filed: Nov. 20, 1988

[51] Int. Cl.[5] ..... B02C 15/00

[52] U.S. Cl. ..... 241/117

[58] Field of Search ..... 384/480, 398, 322, 397, 384/399; 72/236, 237; 241/101.2, 117–121, 130, 216, 231

[56] References Cited

U.S. PATENT DOCUMENTS

| | | | |
|---|---|---|---|
| 1,772,711 | 8/1930 | Dull | 384/480 |
| 3,938,732 | 2/1976 | Schrimper et al. | 241/231 |
| 4,022,387 | 5/1977 | Williams | 241/130 |

*Primary Examiner*—Mark Rosenbaum

[57] ABSTRACT

Improvements are provided for the journals used in rock grinding and similar operations to lubricate the bearings of such a journal in such a way as to prevent contaminants from ever reaching the bearings.

2 Claims, 6 Drawing Sheets

ROLLER MILL JOURNAL LABYRINTH LUBRICATION SYSTEM

FIELD OF THE INVENTION

This invention relates to journals used in rock grinding equipment. More particularly this invention relates to the lubrication and modification of journals used in such equipment as the Raymond Roller Mill.

BACKGROUND OF THE INVENTION

Like many inventors who were sure they had come up with a "better mouse trap", this inventor spent some ten years repairing and rebuilding rock pulverizing machines, that took rock that had been previously crushed in a jaw crusher to ¾" and then pulverizing it to a fine powder in a Raymond Roller mill or similar mill. In the extremely dusty environment inside the grinding mill the contaminating dust combines with the lubricating oil or grease to form a very potent grinding compound. In a short time this grinding compound wears out the bronze bushings and steel shaft, which then requires their repair or replacement.

Maintenance on these mills is quite costly and time-consuming. The parts that need most frequent repair are the journals, the parts that actually take the load of grinding the rock to a fine powder. The journals eventually begin to wobble or may even freeze up. The cause is simple. Contaminants enter the journal and wear out the bearings. In the industry, the life of a journal before it needs repair or replacement might be estimated at only two months. Contaminants from the various kinds of rock take differing lengths of time before the bearings become a problem. Journals for pulverizing rock for talc require much earlier repair than those used for pulverizing limestone. With current journal design it is only a matter of differing lengths of time before the journals must be repaired or replaced.

Taking out and replacing worn-out bearings on the journals is time-consuming. When a mill must be temporarily shut down while the journals are repaired, downtime is costly. Damaged journals have to be removed from the grinding mill. The task of repairing the journals is itself difficult. It may take several hours with a sledge hammer just to break the journal apart. Then the bronze journal bearings, which have suffered a great deal of wear, must be removed and either replaced by new ones or rebuilt. Usually defective bearings are simply replaced. The shaft, however, may need to be built up by welding to return the outside diameter to fit the new or renewed bronze bushings.

There is one major reason for the breakdown of these journals. Contamination from the rock grindings can not be prevented from entering the bearings, and once in the bearings there is no way contaminants can be removed or purged from the journal apart from taking the entire journal apart. It is only a matter of time before enough contamination entering the bearings leads to their breakdown and the necessity of replacing or repairing them.

Then there is the further problem that gradually the roll begins to fidget and wobble o the roll mount and eventually damages the main shaft. In the prior art there was no way to maintain tension to prevent this from happening.

Consideration of the prior art as shown in FIG. 6 demonstrates the problem. This figure shows the journal currently in use in the Raymond Roller Mill, which, with slight modification, has been in use for about half a century. Lubricant is intended to exit the journal at the slinger ring; there is nothing, however to prevent contaminants from entering the bearings at the same point.

There is an obvious need for improvement in the general design of these journals. Such a design needs to incorporate a method by which contaminants can be kept away from the bearings. Additionally a new design needs to prevent the damage to the shaft caused by wobbling and fidgeting.

This invention provides the method of keeping the dust and lubricant apart by preventing the lubricant grease from commingling with the dust, by forcing the lubricant to pass through a labyrinth seal comprised of the main shaft and three round concentric tubes whereby the lubricant passes through the labyrinth from top to bottom as shown in FIGS. 1,2,3, and 5, and at the same time preventing the contaminating dust from going backward in the reverse direction from the normal flow through the labyrinth. In the process of adapting this system to existing journals, applicant has also discovered other alterations in the design which further improve overall performance.

The first prototypes, which were tested in 1984, had problems which needed to be addressed.

The problem of keeping the rollmount on the shaft was first solved by providing a locking key. Later this was discovered to be unnecessary. A tapered friction locking system was found to be totally adequate. The shaft is given a 2° taper where it meets the roll mount and the roll mount is given a 6° taper. Once mounted, it can not easily be forced apart.

At first applicant attempted to retain the half century old bronze bearing design. It was found that although this might be done, they could not provide the long life that modern bearings can provide. They have been replaced with modern Timken type tapered roller bearings.

A further improvement which has not yet been added to the prototype, is to add a microdot temperature sensor which would serve to warn the equipment operator to check the lubricant in the system or to warn of possible trouble.

The preferred embodiment, as described in this application, has been tested now for over a year and found to be reasonably free of problems. Thus applicant has reached the conclusion that with the preferred embodiment of his invention, for all practical purposes the problem of contamination and subsequent early breakdown of roller mill journals has been solved.

Applicant's major improvement to the journal design has been to add the unique labyrinth seal tube system which prevents contaminants from reaching the bearings.

SUMMARY OF THE INVENTION

The novel solution of this invention is to disclose a lubrication system which both lubricates and purges the bearings. The lubricant introduced to the system at the top of the journal can only exit the system after it passes the bearings and then passes through a labyrinth seal tube system to exit safely far away from the bearings.

There is not a continuous pressure flow of lubricant through the seal tubes, but only the intermittent flow at the time of each maintenance and purging operation, when only a small amount of grease is passed through under pressure. This is important because a continuous flow would require a great deal of grease and an excess of grease would contaminate the product.

This labyrinth seal tube system has been found to totally protect the bearings from contamination. In no test case were contaminants found to have worked their way upstream back into the bearings.

Thus the journals can be expected to last as long as the bearings free of contaminants can be expected to last. Applicant's testing has not demonstrated how long that may be, but obviously with high quality bearings it will be many times as long as expected with the previous journal design.

Grease is introduced under pressure through a Zerk fitting at the top of the journal. It then passes through the roller cage of the upper tapered roller bearing; then it passes between the upper housing and the center shaft; then it passes through the lower tapered bearing cage. At this point and just before entering the arrangement of concentric labyrinth seal tubes, grease passes a one-way seal. Three seal tubes have been added to the lower shaft. Thus the grease continues its path down between the first round concentric labyrinth seal tube and the shaft to the bottom of the round concentric labyrinth seal tube where it reverses its direction and proceeds up between the first and second labyrinth seal tubes, and then changes direction downward again between the second and third labyrinth seal tubes to the bottom at which point it exits out between the bottom of the third labyrinth seal tube and the roll mount assembly, carrying with it any contamination which would have to reverse its direction of flow in order to get back to contaminate the bearings.

After testing, it is believed that the one-way grease seal, which was added to stay conservatively safe, may be redundant. Contaminants have been observed backing up normally only part way between the second and third round concentric seal tubes. Only in the case mentioned just below was there any further problem with contamination, and in that case it is believed that proper maintenance had not been maintained. Thus applicant believes that in widespread use it may be indicated that this grease seal can be dispensed with.

General maintenance required is the introduction of grease to the system once a day or once per shift at the Zerk fitting. This process is as easy as lubricating a similar fitting on an automobile car chassis and takes little time. Preferably grease is introduced into the system until clean grease shows at the exit at the bottom. As long as this simple maintenance is kept up, there is no reason to fear bearing breakdown from contamination.

It is believed that this simple regular maintenance is essential. One test journal when taken apart had no lubricant between the second and third round concentric tubes or between the first and second round concentric tubes and had suffered some damage. It appeared that the maintenance person in this case had failed to replace lubricant for too many shifts. Exactly how long the journals can go without checking the lubricant has not been determined. The conservative and safe approach is to check the lubricant either at the beginning or the end of a shift (eight hours).

Proper maintenance is to force lubricant into the system through the Zerk fitting until clean lubricant is observed at the exit area. Then it is a simple matter to wipe off a large excess of grease, or, more normally, if there is only a small amount it would not be enough to warrant wiping off.

For the expedient of fabricating the prototypes, the tubes have been welded in place. It is applicant's intention, if demand for the journals allows a large enough production, to have them forged. Likewise, if production is large enough it is possible that the roll mount could be forged as an integral part of the shaft.

Two means are added to the invention to prevent wobbling or fidgeting on the shaft. In order to keep the roll mount assembly tightly mounted on the shaft, the shaft is given a 2° taper where it meets the roll mount and the roll mount is given a 6° taper. This forms a successful tapered friction locking system.

A further improvement to the design of the journals intended to prevent wobbling or fidgeting on the shaft is to provide a means of giving constant tension to the top and bottom of the journal; Belleville springs at the top of the upper housing and below the roll mount assembly, as indicated clearly in the drawings, succeed in providing this tension.

Additionally, Timken type tapered roller bearings are provided and relocated on the upper shaft to give the journals the longest possible use.

DETAILED DESCRIPTION OF THE INVENTION

Figure 1:
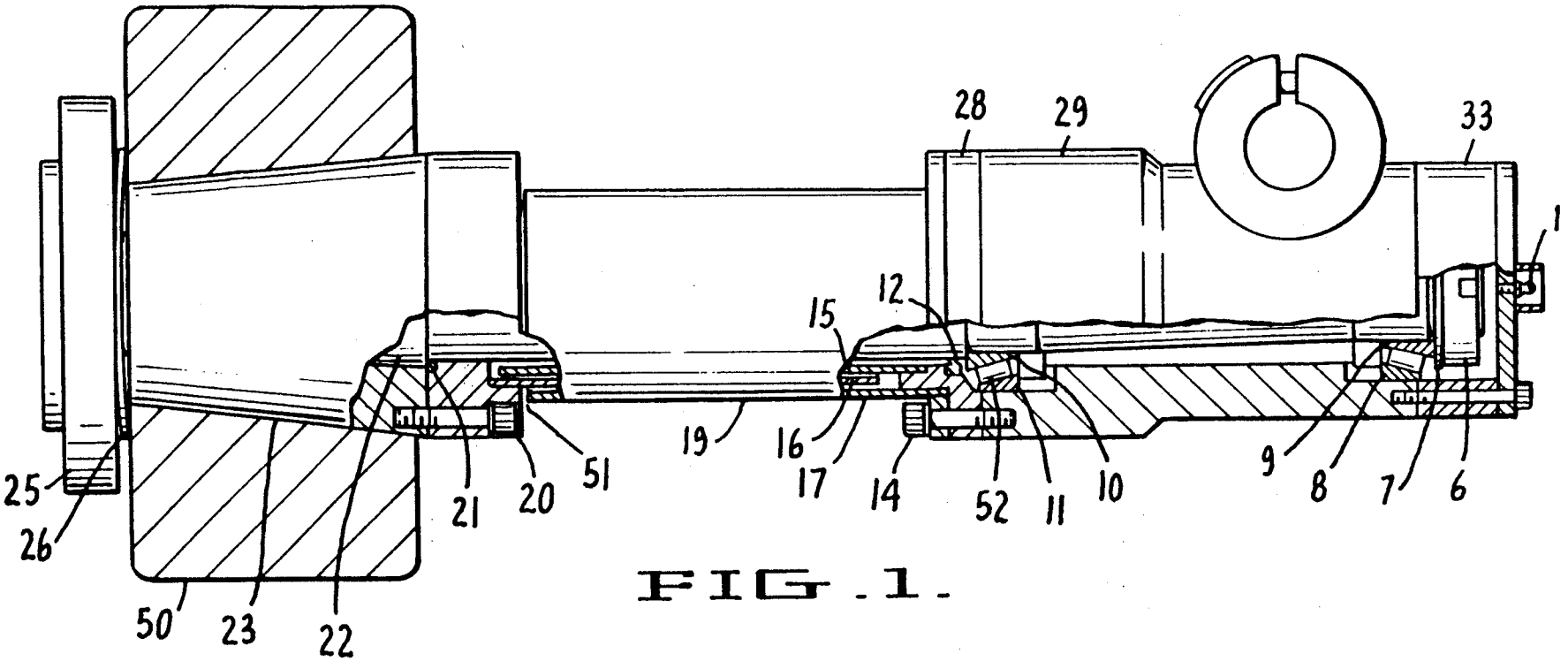
FIG. 1 is a schematic side-view of the roller mill journal of the invention showing the complete redesigned journal with areas cut away to reveal the location of the springs, bearings and seal tubes.

FIG. 1 is a cross-sectional view of the preferred embodiment of the redesigned journal with cut-away areas showing the design of the bearing and lubrication system.

Zerk frtting (1) mounted on cover assembly (33) provides a means for introducing lubricant under pressure.

Bellville spring (7) between Castel Nut (6) and bearings (8) and (9) maintains constant axial loading to prolong journal life. Belleville spring (26) between roll (50) and Roll Nut (25) provides pressure to the roll and prevents the roll from fidgeting on the roll mount (23).

Timkin type roller bearings (of the upper and lower tapered roller bearings), cup bearings (8) and (11) and cone bearings (9) and (10) replace the former bronze bearings.

Parts (15), (16) and (17) are the round tubes concentric with each other which form the unique labyrinth grease seal. The round concentric labyrinth seal tube (15) welded to the upper tube mount (28) is the inner tube. It does not rotate with the roll assembly. The round concentric labyrinth seal tube (16) welded to the lower tube mount (20) is the middle seal tube which does rotate together with the roll assembly. The round concentric labyrinth seal tube (17) welded to the upper tube mount (28) is the outer seal tube. It does not rotate with the roll assembly. As seal tube (17), the outer tube, must withstand constant abuse from the crushed rock, it is about twice as thick as the middle or inner tubes. Lubricant is purged from the labyrinth seal at (51).

Grease seal (12) at the point where grease enters the labyrinth seal tubes after passing the bearings, offers additional protection against any contaminated grease working back to the bearings.

Figure 2:
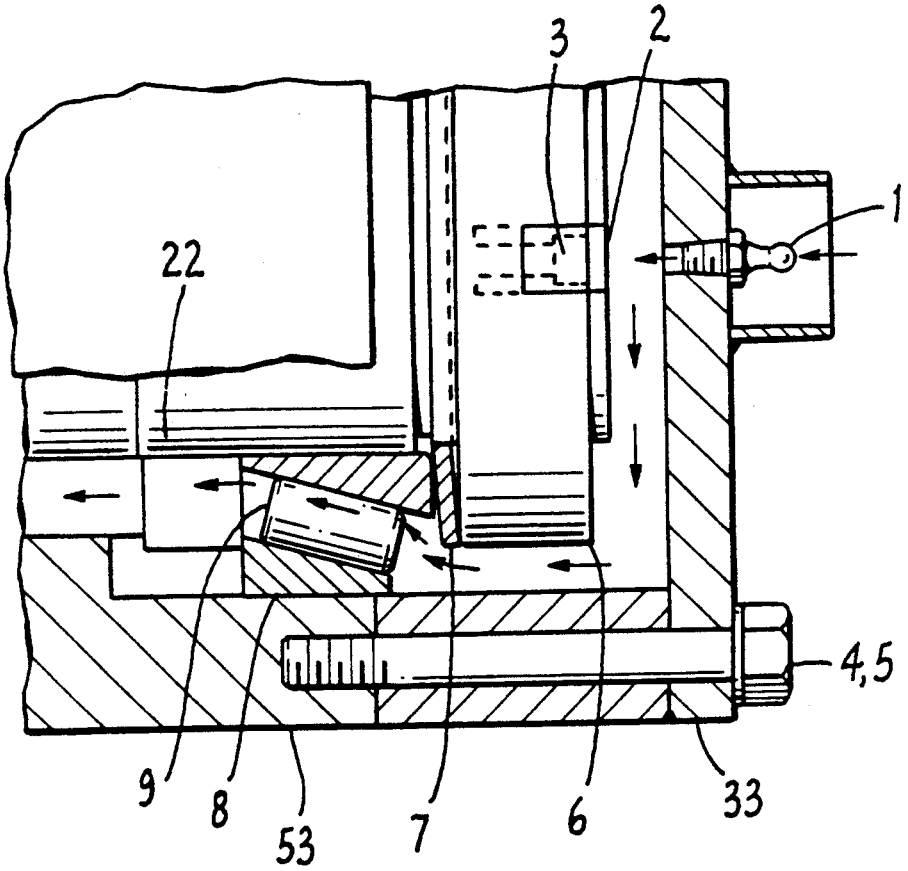
FIG. 2 and 3 are partially cut-away side-views of the roller mill journal of the invention together showing the flow of grease from the intake location in FIG. 2 to the exit location in FIG. 3.

FIG. 2 is an enlargement of the portion of FIG. 1 showing where lubricant begins its course through the journal, with arrows added to indicate the path of lubricant.

Grease is introduced under pressure into the cover assembly (33) through the Zerk fitting (1).

Then it passes around cast steel nut (6) and through the Timken tapered roller bearing cage (9). Then it passes between the upper housing (53) and main shaft (22).

Figure 3:
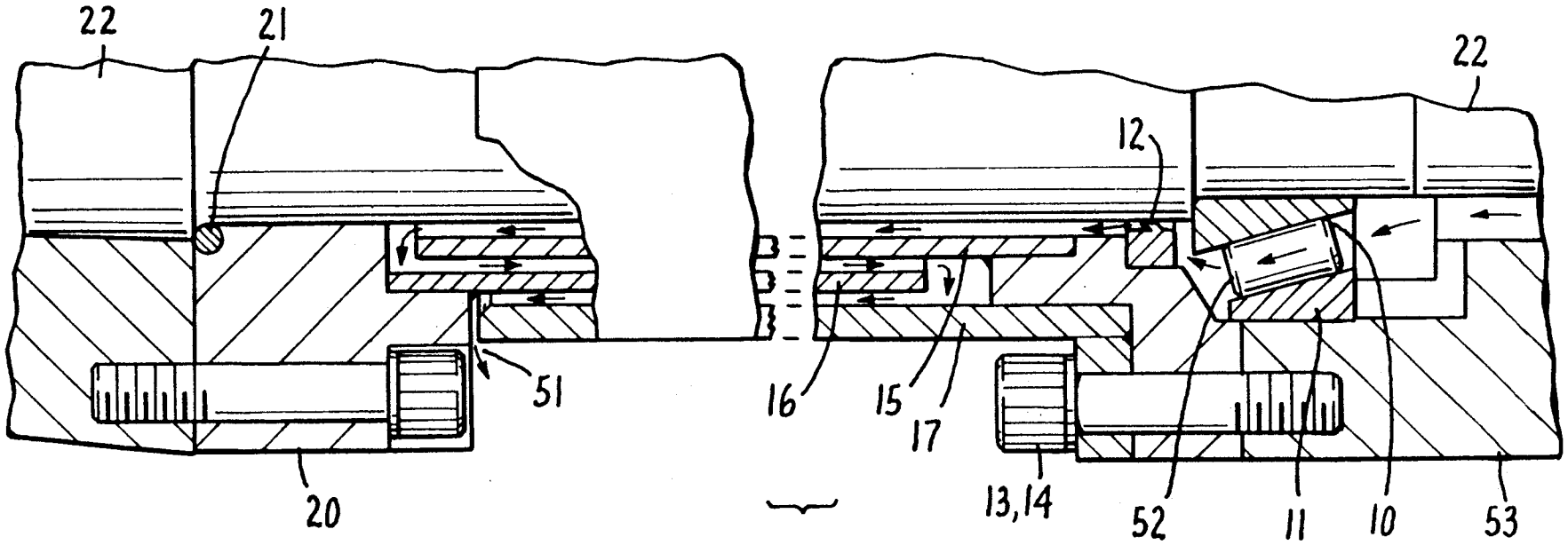

FIG. 3 is an enlargement of the portion of FIG. 1 beyond FIG. 2 showing the remainder of the path lubricant follows through the journal with arrows added to indicate the path of lubricant.

After passing between the main shaft (22) and the upper housing (53), lubricant passes through Timken roller bearings (10) and (11) and then past the one-way grease seal (12).

Here lubricant enters the labyrinth seal tube system. Lubricant passes between the main shaft (22) and inner seal tube (15). Then it reverses its flow and passes between inner seal tube (15) and middle seal tube (16). Then it reverses the direction of flow again to pass between the middle seal tube (16) and outer seal tube (17). Finally it exits the journal at (51).

Figure 4:
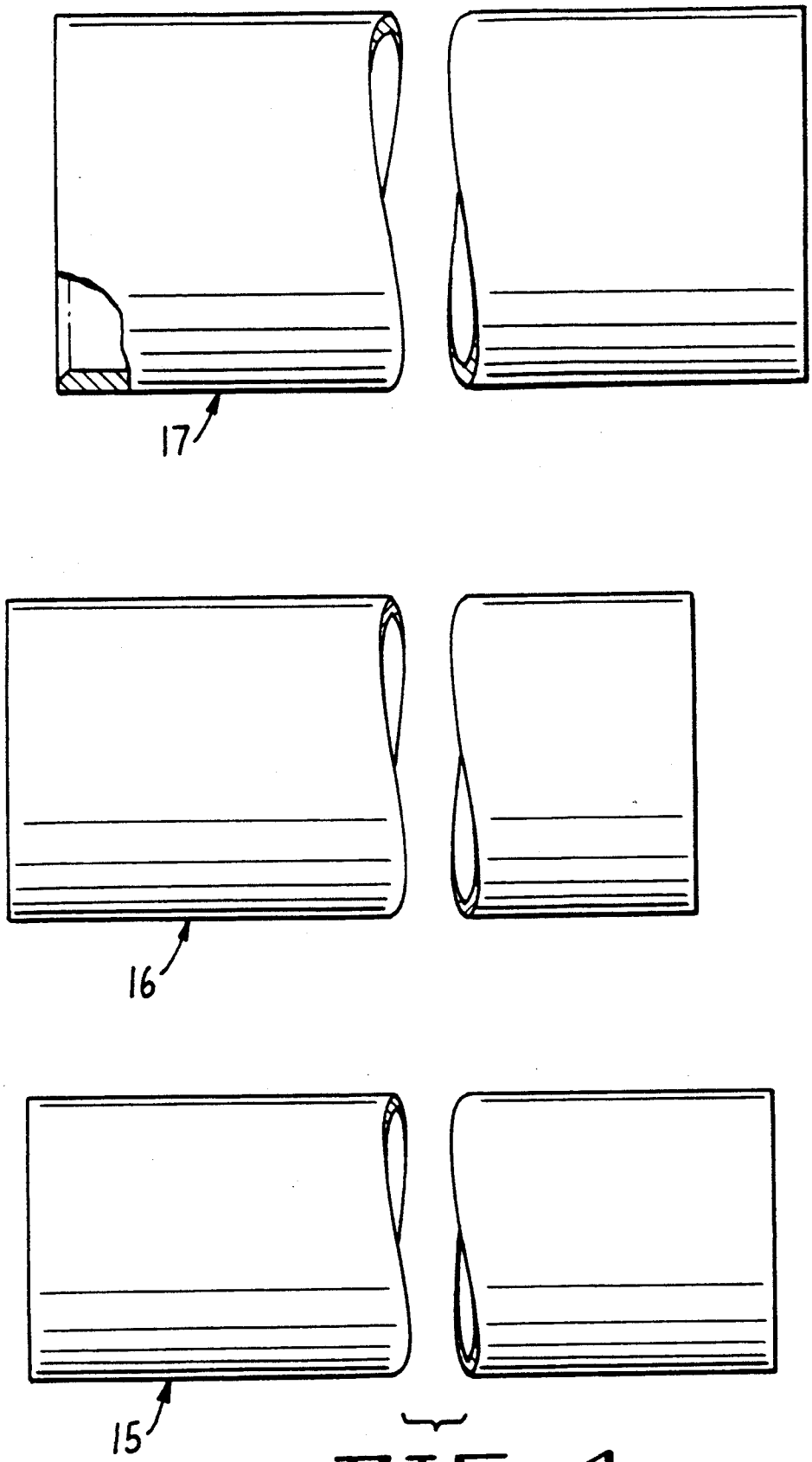
FIG. 4 schematically shows the three round concentric labyrinth seal tubes of the roller mill journal of the invention which fit around the main shaft isolated.

FIG. 4 shows the three round concentric tubes in a cross sectional view. Here are inner seal tube (15), middle seal tube (16) and outer seal tube (17).

Figure 5:
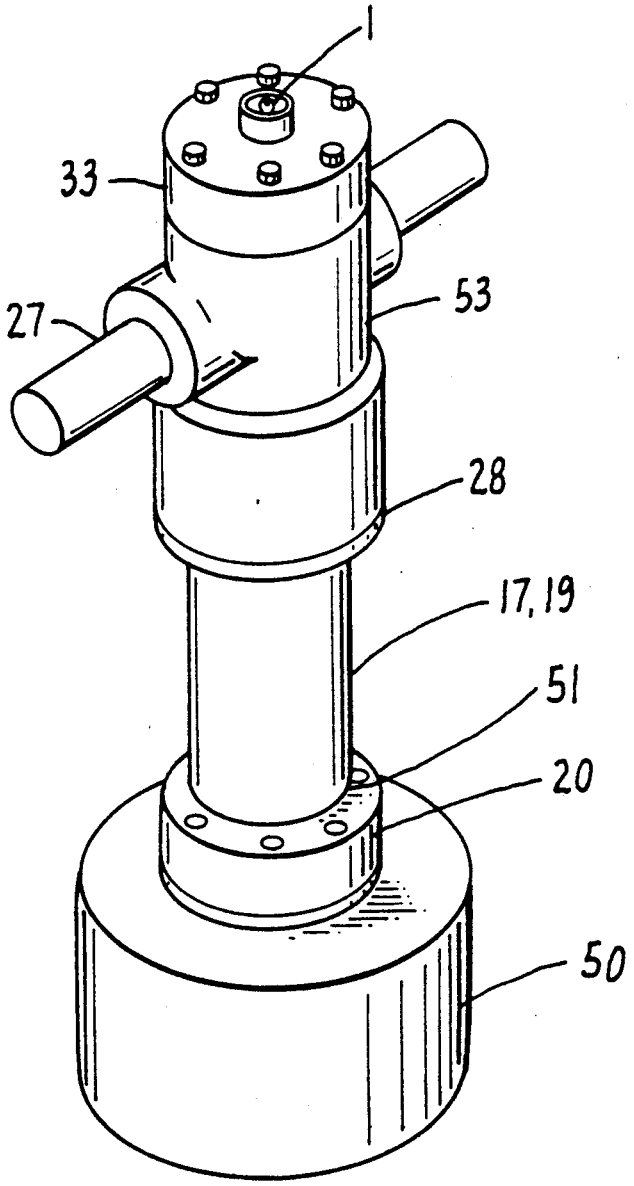
FIG. 5 shows an assembled journal.
Figure 6:
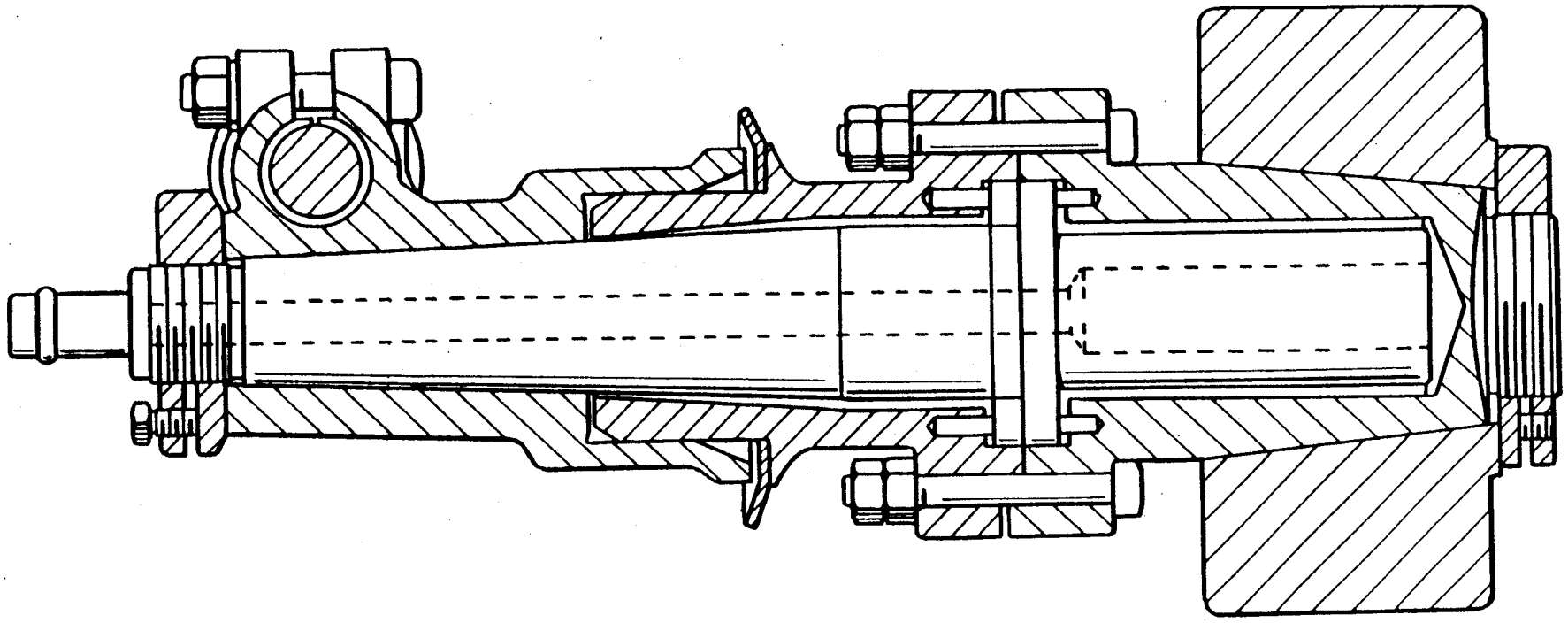
FIG. 6 (PRIOR ART)
FIG. 6 shows an assembled journal of the prior art.

FIG. 5 shows an external view of a journal mounted with the labyrinth seal tubes. Lubricant enters the journal at Zerk fitting (1) and exits at exit point (51) where contaminated lubricant is purged from the system during routine maintenance.

I claim:

1. In a roller mill journal used in rock grinding roller mills comprising a main shaft, a roll mount assembly mounted on the lower end of said shaft including a roll fixed to a lower housing and a locking nut located at the bottom of said shaft fixing said roll to said lower housing, bearings mounted on the upper end of said lower housing adjacent to said main shaft, an upper housing fixed to the top of said main shaft with a cover assembly attached to the extreme top of said upper housing, and means to lubricate said bearings along said shaft including an inlet port mounted on said cover assembly, passageway to said bearings and passageway to an outlet port at a slinger ring mounted on said roll mount assembly, the improvement which comprises:

a means to lubricate and prevent contaminants from entering the bearings of said journal, said means comprising a plurality of concentric tubes positioned parallel to the shaft on said journal beyond said bearings along the flow of lubricant and surrounding said main shaft of said journal with at least one of said tubes mounted to and rotatable with said lower housing of said journal and at least one of said tubes mounted to said upper housing of said journal in such a way as to form a labyrinthine seal between the bearings and an outlet port between a lower tube mounting fixed to said lower housing and an outer tube of said concentric tubes.

2. The roller mill journal of claim 1 in which said concentric seal tubes located parallel to the shaft of said journal comprise:

an outer tube mounted to an upper tube mounting attached to said upper housing;

a middle tube mounted to a middle tube mounting attached to said roll assembly which rotates with the roll assembly; and an inner tube mounted to said upper tube mounting attached to said upper housing.

* * * * *